US010596420B1

(12) United States Patent
Zigouras

(10) Patent No.: US 10,596,420 B1
(45) Date of Patent: Mar. 24, 2020

(54) NOVELTY FOOTBALL AUDIO APPARATUS

(71) Applicant: Pete Zigouras, Livonia, MI (US)

(72) Inventor: Pete Zigouras, Livonia, MI (US)

( * ) Notice: Subject to any disclaimer, the term of this patent is extended or adjusted under 35 U.S.C. 154(b) by 0 days.

(21) Appl. No.: 16/274,848

(22) Filed: Feb. 13, 2019

(51) Int. Cl.
*A63B 43/00* (2006.01)
*A63B 71/06* (2006.01)
*A63B 69/00* (2006.01)

(52) U.S. Cl.
CPC ..... *A63B 43/002* (2013.01); *A63B 69/002* (2013.01); *A63B 71/0622* (2013.01); *A63B 2071/0625* (2013.01)

(58) Field of Classification Search
CPC . A63B 43/002; A63B 71/0622; A63B 69/002; A63B 2071/0625; A63B 41/00; A63B 43/00; A63B 43/004; A63B 43/06
USPC ..... 473/570, 571; D21/712
See application file for complete search history.

(56) References Cited

U.S. PATENT DOCUMENTS 4,577,865 A * 3/1986 Shishido ..... A63B 43/00 473/446
4,595,200 A * 6/1986 Shishido ..... A63B 43/00 473/570
4,662,260 A * 5/1987 Rumsey ..... A63H 5/00 446/408
4,869,504 A * 9/1989 Kralik ..... A63B 41/08 473/597
5,236,383 A * 8/1993 Connelly ..... A63B 43/007 446/219
5,288,069 A * 2/1994 Matsumoto ..... A63B 43/00 446/484
5,316,293 A 5/1994 Hamilton
5,375,839 A * 12/1994 Pagani ..... A63B 43/00 446/409
5,445,375 A * 8/1995 Sweeny ..... A63B 43/00 273/146
5,779,576 A * 7/1998 Smith, III ..... A63B 65/00 473/570
6,251,035 B1 * 6/2001 Fa ..... A63B 41/00 473/570
D453,037 S * 1/2002 Frisina ..... D21/712
6,582,330 B1 * 6/2003 Rehkemper ..... A63B 41/00 446/484
D676,828 S * 2/2013 Clark ..... D14/207
(Continued)

FOREIGN PATENT DOCUMENTS

CN 208094770 U * 11/2018
GB 2555786 A * 5/2018 ..... A63B 71/0622

*Primary Examiner* — Steven B Wong

(57) ABSTRACT

A novelty football audio apparatus for playing fight songs to show school pride includes a football body having a football-shaped skin forming an inner cavity. The skin has an exterior, an interior, and an access aperture extending through to the inner cavity. An access panel is coupled to the football body to cover and alternatively uncover the access aperture. A set of imitation laces is coupled to the football body and is configured to represent laces from a real football. An electronics housing is coupled to the interior of the skin within the inner cavity beneath the access aperture. A tone generator coupled within the electronics housing. A speaker is coupled within the skin above the electronics housing and is in operational communication with the tone generator. A power button is coupled within the skin above the electronics housing and is in operational communication with the tone generator.

1 Claim, 4 Drawing Sheets

(56) References Cited

U.S. PATENT DOCUMENTS

| | | | | |
|---|---|---|---|---|
| D752,547 | S * | 3/2016 | Chen | D14/207 |
| 2003/0109338 | A1* | 6/2003 | Oister | A63B 43/00 473/570 |
| 2003/0109339 | A1* | 6/2003 | Oister | A63B 43/00 473/570 |
| 2009/0048044 | A1* | 2/2009 | Oleson | A63B 24/0062 473/570 |
| 2012/0157246 | A1* | 6/2012 | Glover | A63B 43/00 473/570 |
| 2012/0244969 | A1* | 9/2012 | Binder | A63H 33/18 473/570 |
| 2012/0295740 | A1* | 11/2012 | Creguer | A63B 71/0622 473/422 |
| 2014/0301595 | A1 | 10/2014 | Egleston | |
| 2014/0309059 | A1* | 10/2014 | Minch | A63B 43/06 473/422 |
| 2018/0117444 | A1 | 5/2018 | Killough | |
| 2019/0158942 | A1* | 5/2019 | Lee | H04R 1/025 |

* cited by examiner

NOVELTY FOOTBALL AUDIO APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to novelty footballs and more particularly pertains to a new novelty football for playing fight songs to show school pride.

BRIEF SUMMARY OF THE INVENTION

An embodiment of the disclosure meets the needs presented above by generally comprising a football body having a football-shaped skin forming an inner cavity. The skin has an exterior, an interior, and an access aperture extending from the exterior through the interior to the inner cavity. An access panel is coupled to the football body to cover and alternatively uncover the access aperture. A set of imitation laces is coupled to the football body and is configured to represent laces from a real football. An electronics housing is coupled to the interior of the skin within the inner cavity beneath the access aperture. A tone generator coupled within the electronics housing. A speaker is coupled within the skin above the electronics housing and is in operational communication with the tone generator. A power button is coupled within the skin above the electronics housing and is in operational communication with the tone generator.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
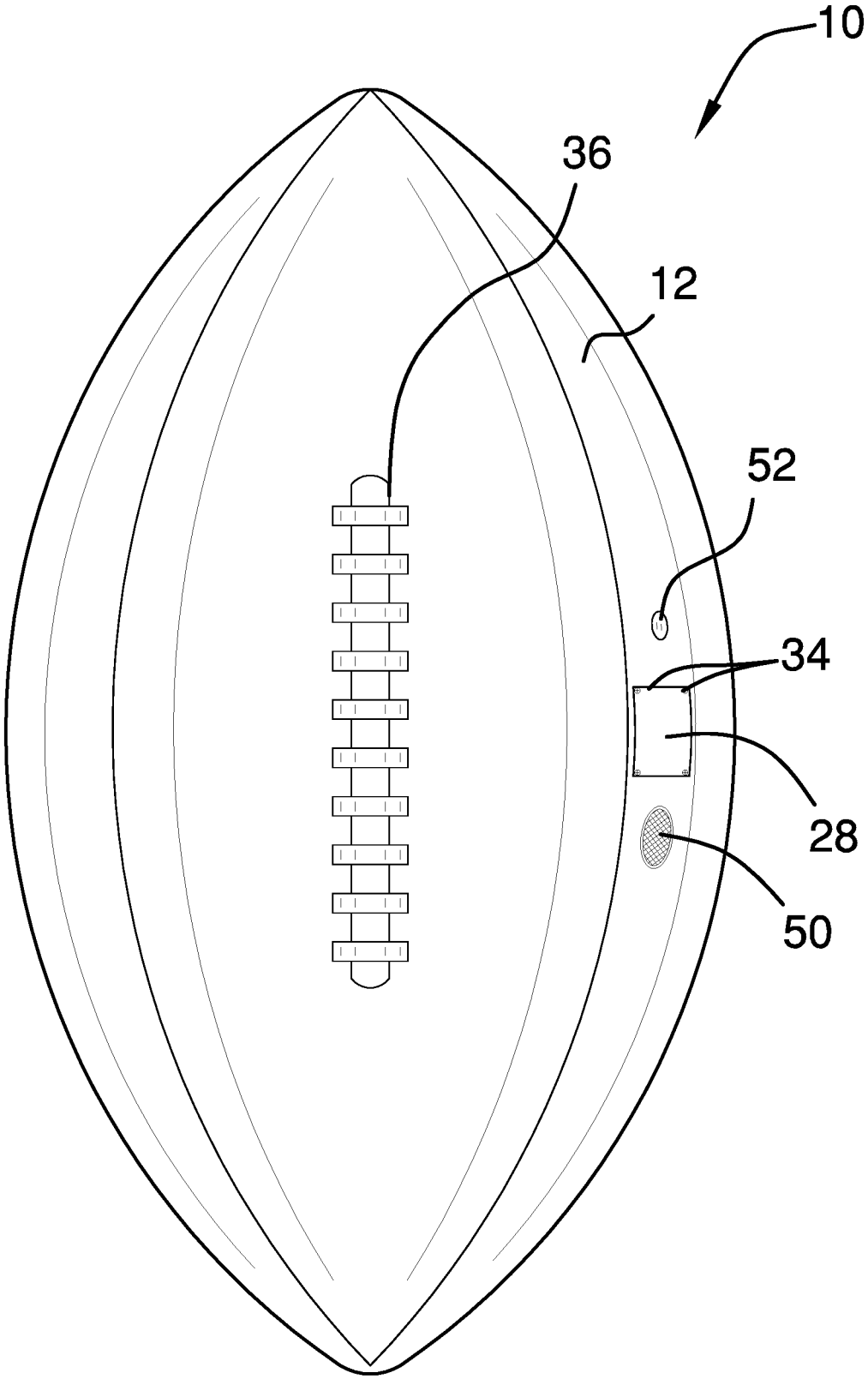
FIG. 1 is a front elevation view of a novelty football audio apparatus according to an embodiment of the disclosure.
Figure 2:
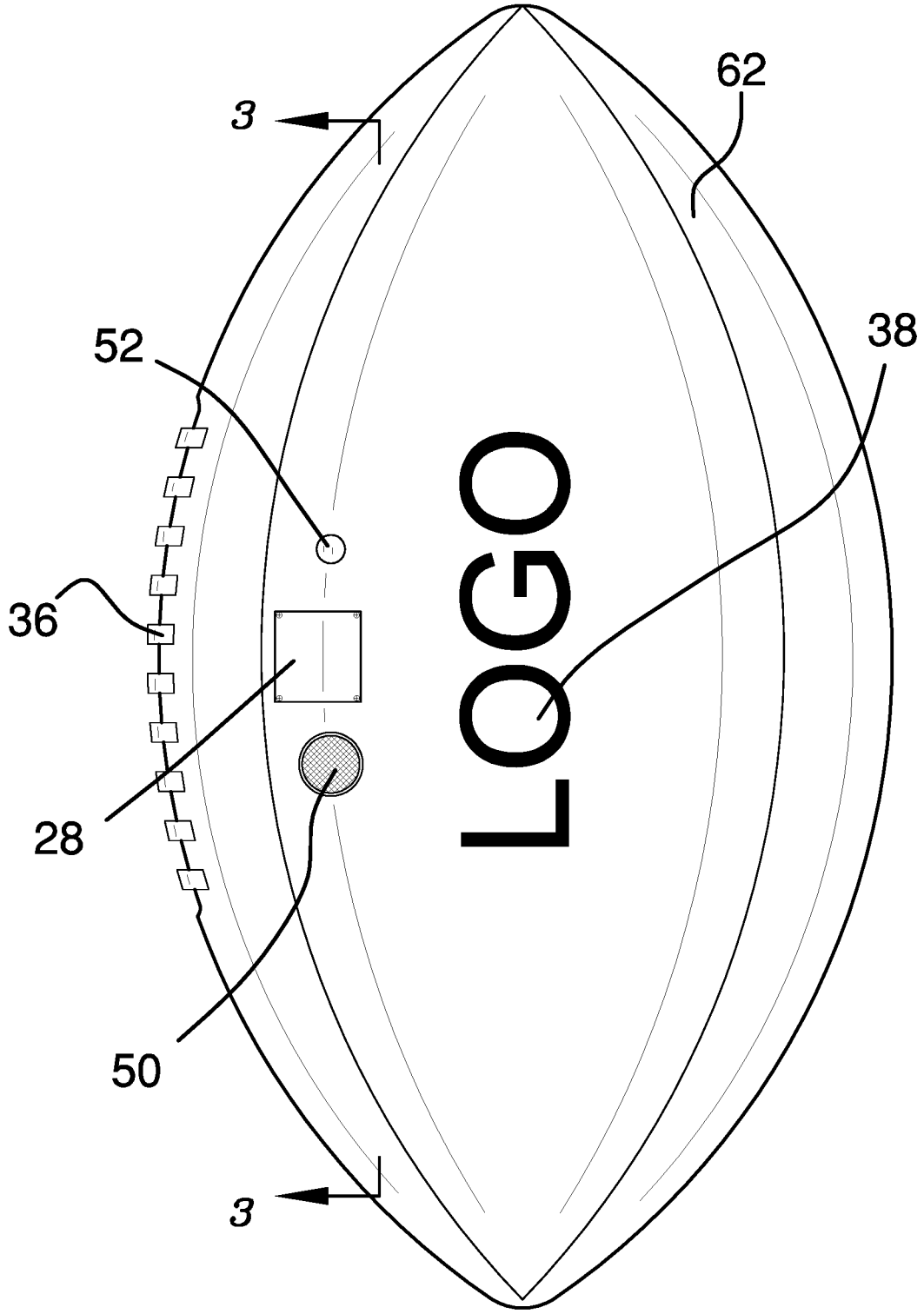
FIG. 2 is a side elevation view of an embodiment of the disclosure.
Figure 3:
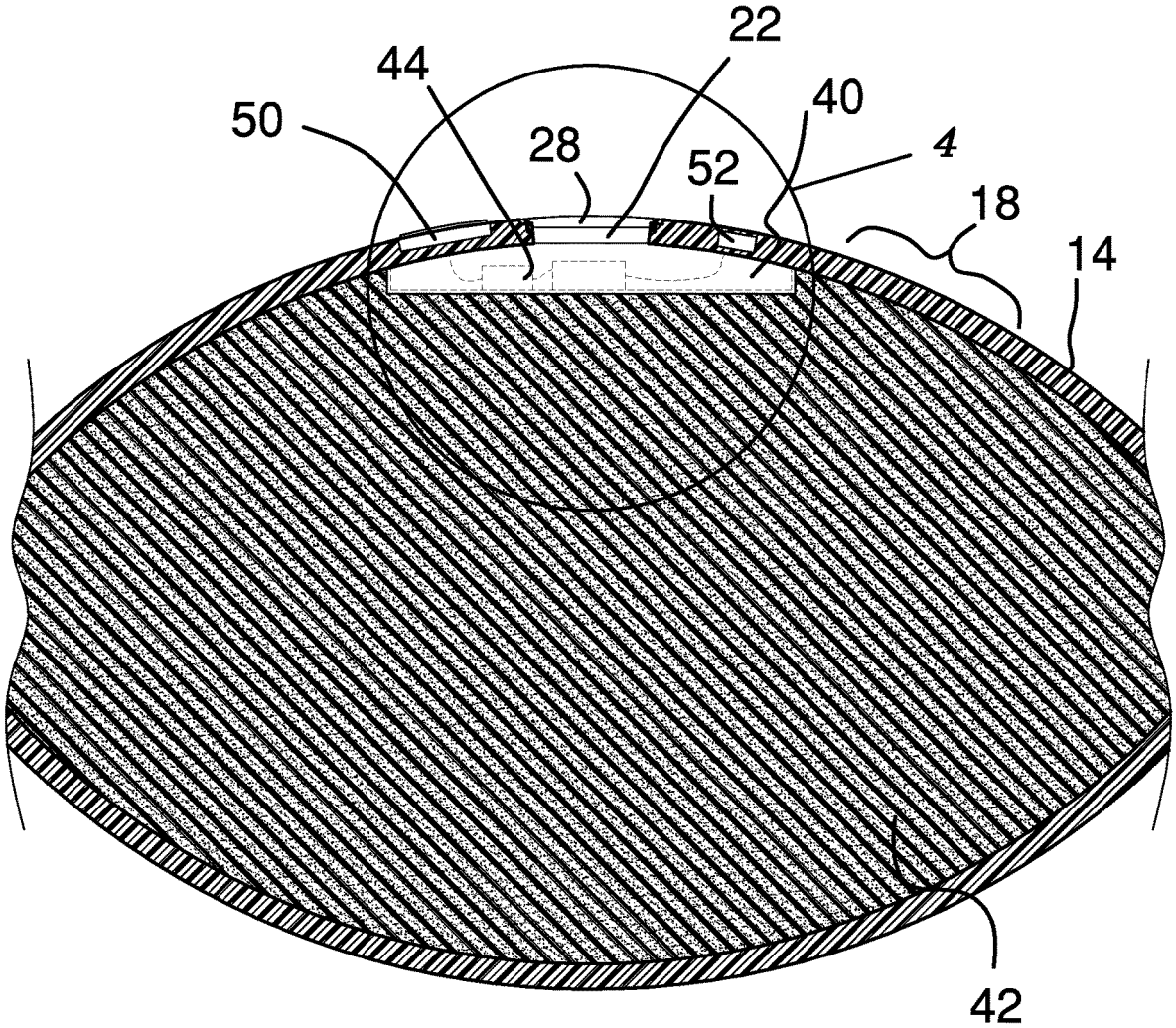
FIG. 3 is a cross-sectional view of an embodiment of the disclosure along line 3-3 of FIG. 2.
Figure 4:
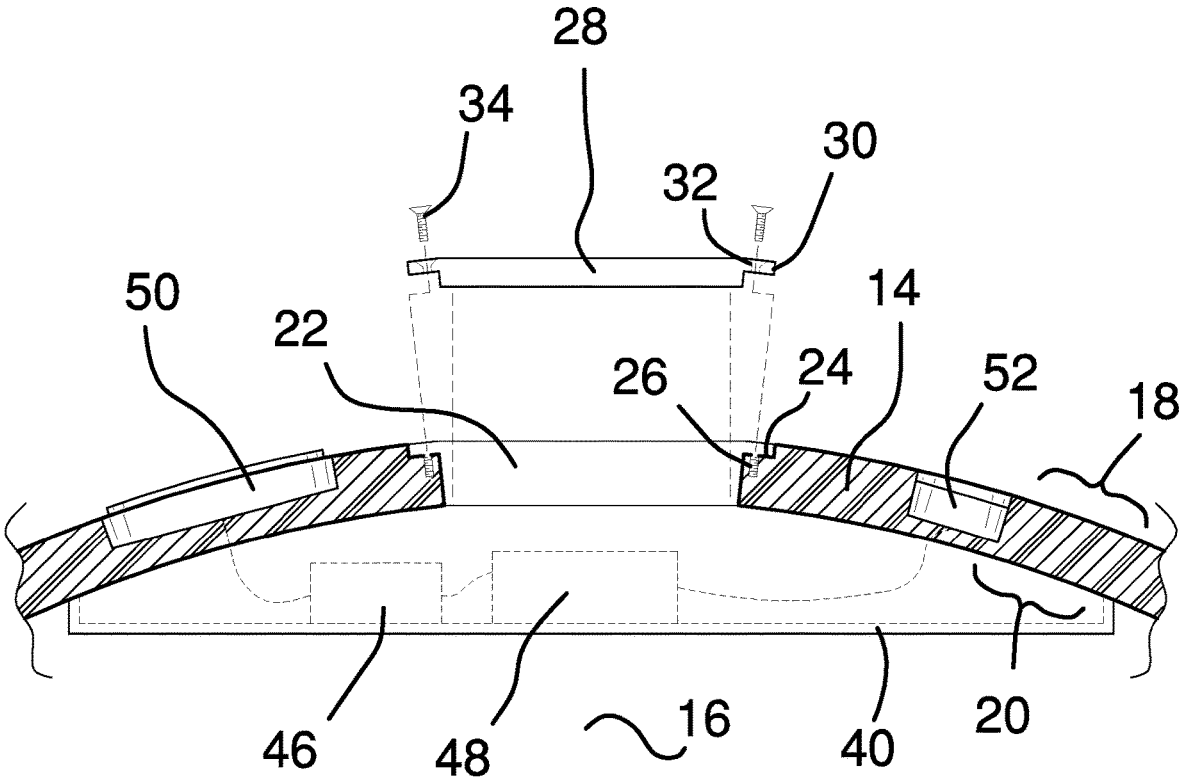
FIG. 4 is a detail view of an embodiment of the disclosure of area 4 of FIG. 3.

With reference now to the drawings, and in particular to FIGS. 1 through 4 thereof, a new novelty football embodying the principles and concepts of an embodiment of the disclosure and generally designated by the reference numeral 10 will be described.

As best illustrated in FIGS. 1 through 4, the novelty football audio apparatus 10 generally comprises a football body 12 having a football-shaped skin 14 forming an inner cavity 16. The skin 14 has an exterior 18, an interior 20, and an access aperture 22 extending from the exterior 18 through the interior 20 to the inner cavity 16. The access aperture 22 may have a rim 24 adjacent the exterior 18 of the skin and the rim 24 may have a plurality of mounting apertures 26. An access panel 28 is coupled to the football body 12. The access panel 28 has a lip 30 corresponding to the rim 24 such that the access panel 28 mounts flush with the exterior 18. The lip 30 has a plurality of through apertures 32 aligning with the plurality of mounting apertures 26. The access panel 28 covers and alternatively uncovers the access aperture 22 and the plurality of mounting apertures 26 and the plurality of through apertures 32 are configured to receive a plurality of fasteners 34 to secure the access panel 28 to the access aperture 22.

A set of imitation laces 36 is coupled to the football body 12 and is configured to represent laces from a real football. A logo 38 is coupled to the skin 14 90° apart from the set of imitation laces 36 around the football body 12. The logo 38 may be any team logo and may be produced in a variety of sizes and colors. An electronics housing 40 is coupled to the interior 20 of the skin within the inner cavity 16 beneath the access aperture 22. A protective foam 42 may be coupled to the football body 12. The protective foam 42 is continuously disposed within the inner cavity 16 outside the electronics housing 40 to maintain the football shape of the football body 12 and to secure the electronics housing 40. A tone generator 44 is coupled within the electronics housing 40 and comprises a microprocessor 46 and a battery 48. The battery 48 provides power to the microprocessor 46 and the microprocessor 46 stores and produces a team fight song. A speaker 50 is coupled within the skin 14 above the electronics housing 40 and is in operational communication with the tone generator 44. A power button 52 is coupled to the football body 12 within the skin 14 above the electronics housing 40 such that it rests flush with the exterior 18. The power button 52 is in operational communication with the tone generator 44. The power button 52, the access aperture 22, and the speaker 50 are linearly aligned parallel to, and 70° apart from, the set of imitation laces 36 around the football body 12 between the set of imitation laces 36 and the logo 38.

In use, the power button 52 is depressed to activate the tone generator 44 to produce the team fight song through the speaker 50. The access panel 28 may be removed to utilize the access aperture 22 to replace the battery 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A novelty football audio apparatus comprising:

a football body, the football body having a football-shaped skin forming an inner cavity, the skin having an exterior, an interior, and an access aperture extending from the exterior through the interior to the inner cavity, the access aperture having a rim adjacent the exterior of the skin, the rim having a plurality of mounting apertures;

an access panel coupled to the football body, the access panel having a lip corresponding to the rim such that the access panel mounts flush with the exterior, the lip having a plurality of through apertures aligning with the plurality of mounting apertures, the access panel covering and alternatively uncovering the access aperture, the plurality of mounting apertures and the plurality of through apertures being configured to receive a plurality of fasteners to secure the access panel to the access aperture;

a set of imitation laces coupled to the football body, the set of imitation laces being configured to represent laces from a real football;

a logo coupled to the football body, the logo being coupled to the skin 90° apart from the set of imitation laces around the football body;

an electronics housing coupled to the football body, the electronics housing being coupled to the interior of the skin within the inner cavity beneath the access aperture;

a protective foam coupled to the football body, the protective foam being continuously disposed within the inner cavity outside the electronics housing;

a tone generator coupled within the electronics housing, the tone generator comprising a microprocessor and a battery, the battery providing power to the microprocessor the microprocessor storing and producing a team fight song;

a speaker coupled to the football body, the speaker being coupled within the skin above the electronics housing, the speaker being in operational communication with the tone generator; and a power button coupled to the football body, the power button being coupled within the skin above the electronics housing such that it rests flush with the exterior, the power button being in operational communication with the tone generator, the power button activating the tone generator to produce the team fight song through the speaker;

wherein the power button, the access aperture, and the speaker are linearly aligned parallel to, and 70° apart from, the set of imitation laces around the football body between the set of imitation laces and the logo.

* * * * *